US012484693B1

(12) United States Patent
Shah

(10) Patent No.: US 12,484,693 B1
(45) Date of Patent: Dec. 2, 2025

(54) HEIGHT ADJUSTABLE WORKSTATION

(71) Applicant: Biran Shah, Alpharetta, GA (US)

(72) Inventor: Biran Shah, Alpharetta, GA (US)

( * ) Notice: Subject to any disclaimer, the term of this patent is extended or adjusted under 35 U.S.C. 154(b) by 0 days.

(21) Appl. No.: 19/207,083

(22) Filed: May 13, 2025

(51) Int. Cl.

| | |
|---|---|
| ***A47B 9/04*** | (2006.01) |
| ***A47B 9/20*** | (2006.01) |
| ***A47B 21/02*** | (2006.01) |
| ***A47B 21/04*** | (2006.01) |

(52) U.S. Cl.
CPC ..... *A47B 9/04* (2013.01); *A47B 9/20* (2013.01); *A47B 21/02* (2013.01); *A47B 21/04* (2013.01); *A47B 2200/0051* (2013.01); *A47B 2200/0059* (2013.01)

(58) Field of Classification Search
CPC .. A47B 9/04; A47B 9/20; A47B 21/02; A47B 21/04; A47B 2200/0051; A47B 2200/0059
USPC .... 108/144.11, 147, 147.13, 147.15, 147.16, 108/147.11, 147.17, 147.19, 50.01
See application file for complete search history.

(56) References Cited

U.S. PATENT DOCUMENTS

| | | | | |
|---|---|---|---|---|
| 3,608,462 A * | 9/1971 | Groshong | G03B 15/14 | 396/428 |
| 3,908,565 A * | 9/1975 | Burnett | A47B 23/046 | 108/150 |
| 4,635,565 A * | 1/1987 | Novak | A47B 9/08 | 108/147 |
| 5,088,420 A * | 2/1992 | Russell | A47B 21/045 | 108/106 |
| 5,483,903 A * | 1/1996 | Pierce | A47B 9/20 | 108/108 |
| 5,687,654 A * | 11/1997 | Huggins | A47B 83/02 | 108/106 |
| 7,077,068 B1 | 7/2006 | Agee | | |
| 7,195,213 B2 * | 3/2007 | Weatherly | A47B 81/061 | 248/125.1 |
| 8,087,737 B2 | 1/2012 | Shoenfeld | | |
| 8,109,527 B2 * | 2/2012 | Bustle | A61G 12/001 | 280/47.35 |

(Continued)

FOREIGN PATENT DOCUMENTS

| | | |
|---|---|---|
| CA | 3028426 C | 3/2021 |
| CN | 109700183 B | 11/2023 |

(Continued)

OTHER PUBLICATIONS

Flexispot, Dec. 13, 2024, https://www.flexispot.com.

(Continued)

*Primary Examiner* — Jose V Chen
(74) *Attorney, Agent, or Firm* — Ballard Spahr LLP

(57) ABSTRACT

Presented herein is a device, such as a height adjustable workstation, including at least one leg. Each leg extends along a vertical axis and includes a base. A vertical support is coupled to the base. A sleeve is adjustably coupled to the base and movable along the vertical axis relative to the vertical support. The sleeve has a first end and a second oppositely disposed along the vertical axis. A panel defining a work surface has a height measured from the base. The panel is attached to the sleeve between the first end and the second end of the sleeve. The panel is adjustably coupled to the base such that the work surface is moveable from a first height to a second height.

18 Claims, 8 Drawing Sheets

(56) References Cited

U.S. PATENT DOCUMENTS

| | | | | |
|---|---|---|---|---|
| 8,276,526 | B2 * | 10/2012 | Verweij | A47B 9/20 248/188.4 |
| 8,662,605 | B2 * | 3/2014 | McRorie | A61B 50/13 108/50.01 |
| 8,789,474 | B2 * | 7/2014 | Kim | A47B 41/02 108/50.01 |
| 9,504,316 | B1 | 11/2016 | Streicher et al. | |
| 9,635,932 | B2 | 5/2017 | Kelley et al. | |
| 9,655,438 | B1 | 5/2017 | Shoenfeld et al. | |
| 9,723,919 | B1 * | 8/2017 | Randolph | A47B 21/02 |
| 9,723,920 | B1 * | 8/2017 | Wu | H02K 7/06 |
| 10,039,372 | B2 | 8/2018 | Ergun et al. | |
| 10,126,731 | B2 | 11/2018 | Lindström | |
| 10,258,150 | B2 | 4/2019 | Lin | |
| 10,413,053 | B2 | 9/2019 | Flaherty et al. | |
| 10,470,563 | B2 | 11/2019 | Keller et al. | |
| 10,499,730 | B2 | 12/2019 | Kim et al. | |
| 10,524,565 | B2 | 1/2020 | Ergun et al. | |
| 10,531,732 | B1 * | 1/2020 | Huang | F16B 7/14 |
| 10,548,294 | B1 | 2/2020 | Price | |
| 10,802,473 | B2 | 10/2020 | Labrosse et al. | |
| 10,939,753 | B2 | 3/2021 | Hazzard et al. | |
| 11,129,471 | B1 * | 9/2021 | Oglesby | A47B 13/023 |
| 11,311,102 | B2 | 4/2022 | Swartz et al. | |
| 11,324,310 | B2 | 5/2022 | Xiang et al. | |
| 11,457,726 | B2 * | 10/2022 | Wallis | A47B 21/03 |
| 11,553,789 | B2 | 1/2023 | Knapp et al. | |
| 11,771,218 | B2 | 10/2023 | Laudadio et al. | |
| 2007/0227409 | A1 * | 10/2007 | Chu | A47B 21/00 108/50.02 |
| 2009/0057501 | A1 | 3/2009 | Huang | |
| 2016/0170402 | A1 * | 6/2016 | Lindström | A47B 9/00 700/275 |
| 2017/0354245 | A1 | 12/2017 | Martin et al. | |
| 2019/0261778 | A1 * | 8/2019 | Lukas | G01S 7/497 |
| 2020/0077788 | A1 * | 3/2020 | Albers | A47B 9/20 |
| 2021/0015250 | A1 * | 1/2021 | Chu | A47B 17/02 |
| 2021/0177136 | A1 * | 6/2021 | Koenig | A47B 9/20 |
| 2021/0259403 | A1 * | 8/2021 | Swetharanyam | A47B 9/20 |
| 2021/0311445 | A1 | 10/2021 | Matlin | |
| 2022/0265038 | A1 * | 8/2022 | Walls | A47B 9/02 |
| 2024/0099456 | A1 | 3/2024 | Addington et al. | |
| 2024/0407543 | A1 * | 12/2024 | Mensing | A47B 21/04 |
| 2025/0169601 | A1 * | 5/2025 | Chen | H02M 1/0003 |

FOREIGN PATENT DOCUMENTS

| | | | |
|---|---|---|---|
| JP | 6449436 | B2 | 1/2019 |
| RU | 2718351 | C2 | 4/2020 |

OTHER PUBLICATIONS

Desk Haus, Dec. 13, 2024, https://desk.haus.
Hermanmiller, Dec. 13, 2024, https://www.hermanmiller.com.
Erichkeller, Dec. 13, 2024, https://erichkeller.com.
Uplift Desk, Dec. 13, 2024, https://www.upliftdesk.com.
Ikea, Dec. 13, 2024, https://www.ikea.com.
Medicus Health, Dec. 13, 2024, https://www.medicus-health.com.

* cited by examiner

HEIGHT ADJUSTABLE WORKSTATION

TECHNICAL FIELD

This disclosure relates generally to a workstation and, more particularly, to a height adjustable workstation.

BACKGROUND

Ergonomics is a scientific discipline directed to designing a work environment in a way that increases efficiency and productivity while minimizing risk of injury and discomfort to the worker. When a person uses a workstation (e.g., a desk, table, worktop, or other apparatus with a work surface) to complete a task, ergonomic considerations may include, for example, whether a configuration of the workstation allows the person to move and rest in positions that are comfortable and conducive to their work. A workstation configuration that forces the person into unnatural, uncomfortable positions, may result in injury and unproductivity. For example, a workstation positioned at an unsuitable height for the person or work may cause the person to strain muscles in their arms, torso, and neck, and may even increase the person's risk for developing musculoskeletal disorders.

A height adjustable workstation allows a person to set a height of a work surface according to the person's specific needs and preferences. Conventional height adjustable workstations provide only a narrow range of height adjustment, with a minimum height setting that may be too high for a person to sit in an ergonomically favorable orientation, and a maximum height setting that is relatively low due to stability limitations. Conventional height adjustable workstations also provide limited usable space and undesirable ergonomics because they typically include only a single work surface for all work materials, regardless of the ergonomic needs associated with the work materials. For example, a conventional height adjustable desk provides only a single surface for a monitor or other peripheral devices, keyboard, mouse, book, notepad, etc. For a person to simultaneously view the monitor (or other peripheral device) with their eyes and manipulate the keyboard, mouse, book, or notepad with their hands, they are forced to either hunch their shoulders (so that their arms and hands are elevated when the monitor is at eye level and a neutral neck orientation) or strain their neck downward (to allow for a neutral shoulder position when the monitor is at a lower height). It would be beneficial to improve workstation ergonomics. More specifically, it would be advantageous to develop workstations that provide a wider ranger of work surface heights, more work surface area, and/or the ability to adjust placement of monitors or other peripheral devices to further increase efficiency and productivity while reducing risk of injury and discomfort to the worker.

SUMMARY

An example device is disclosed herein. The device comprises a base. A panel defines a work surface having a height measured from the base. The panel is adjustably coupled to the base such that the work surface is moveable from a first height to a second height. The second height is more than twice the first height.

An example device disclosed herein comprises at least one leg. Each leg of the at least one leg extends along a vertical axis. Each leg comprises a base. A vertical support is coupled to the base. A sleeve has a first end and a second end oppositely disposed along the vertical axis. The second end is closer to the base than the first end to the base. The sleeve is movable along the vertical axis relative to the vertical support. A panel defines a work surface having a height measured from the base along an axis parallel or substantially parallel to the vertical axis. The panel is attached to the sleeve between the first end and the second end. The sleeve is configured to adjust the height of the work surface.

An example method of adjusting a device is disclosed herein. The device comprises a panel defining a work surface. The work surface has a height measured from a base of the device. The work surface is moveable from a first height to a second height. The second height is more than twice the first height. The method comprises moving the work surface from a third height to a fourth height. The third height and the fourth height are between the first height and the second height.

Additional advantages of the present disclosure will be set forth in part in the description that follows, and in part will be obvious from the description, or may be learned by practice of the example embodiments disclosed herein. The advantages of the present disclosure will be realized and attained by means of the elements and combinations particularly pointed out in the appended claims.

It is to be understood that both the foregoing general description and the following detailed description are exemplary and explanatory only and are not restrictive of the invention as claimed.

BRIEF DESCRIPTION OF THE DRAWINGS

These and other features of example embodiments of the present disclosure are described below with reference to the appended drawings, wherein.

DETAILED DESCRIPTION

Figure 1:
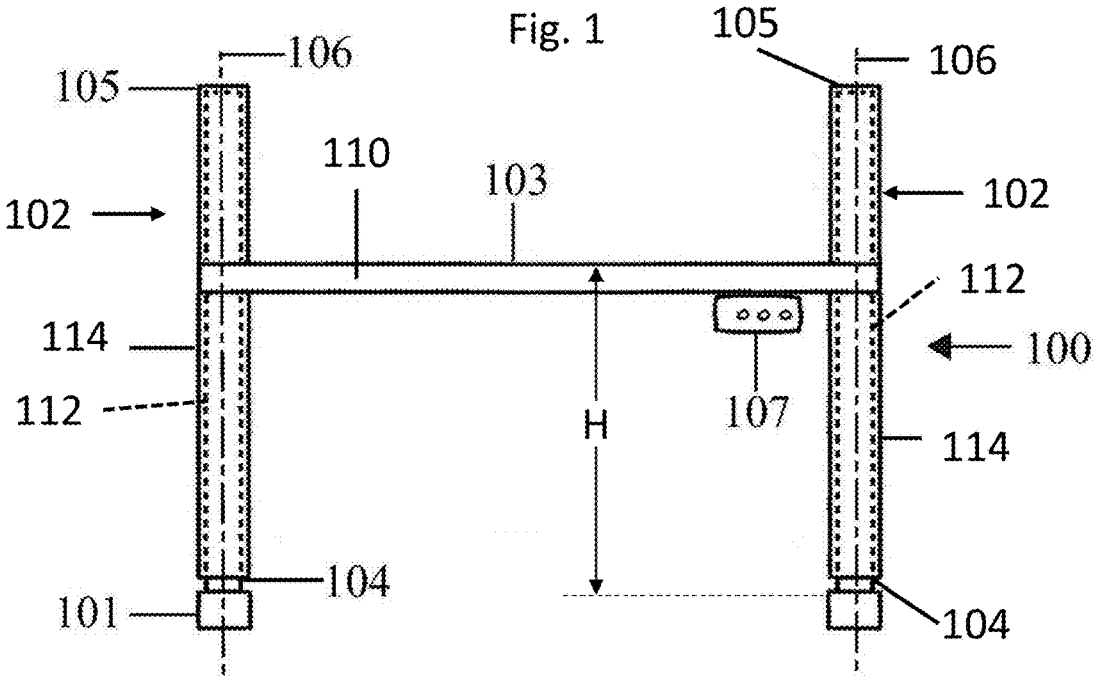
FIG. 1 is a front elevation view of a height adjustable workstation, according to an example embodiment.

Example embodiments will be described more fully hereinafter with reference to the accompanying drawings in which some, but not all, embodiments of the present disclosure are shown. Indeed, aspects of the present disclosure may be embodied in many different forms and should not be construed as limited to the example embodiments set forth herein. Like numbers refer to like elements throughout.

As used herein, the singular forms "a," "an" and "the" include plural referents unless the context clearly dictates otherwise.

As used herein, the terms "optional" or "optionally" mean that the subsequently described element or step may or may not be included, and that the description includes instances where the element or step is included and instances where it is not included.

As used herein, the term "or" means any one member of a particular list and, except where otherwise indicated, can also include any combination of members of that list. Similarly, as used herein, unless expressly stated to the contrary, use of the phrase "at least one of," "one or more of," "and/or," variations thereof, or the like, are open-ended expressions that are both conjunctive and disjunctive in operation for any and all possible combination of the associated listed items. For example, each of the expressions "at least one of X, Y and Z", "at least one of X, Y or Z", "one or more of X, Y or Z" and "X, Y and/or Z" can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z.

Unless expressly stated to the contrary, the terms "first," "second," "third," etc., are intended to distinguish the particular nouns they modify (e.g., element, condition, node, module, activity, operation, etc.). Unless expressly stated to the contrary, the use of these terms is not intended to indicate any type of order, rank, importance, temporal sequence, or hierarchy of the modified noun. For example, "first X" and "second X" are intended to designate two "X" elements that are not necessarily limited by any order, rank, importance, temporal sequence, or hierarchy of the two elements. Further as referred to herein, "at least one of" and "one or more of" can be represented using the "(s)" nomenclature (e.g., one or more element(s)).

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

As used herein, the term "between" means any place within a range defined by the endpoints, and the span of that range includes the endpoints.

Figure 2:
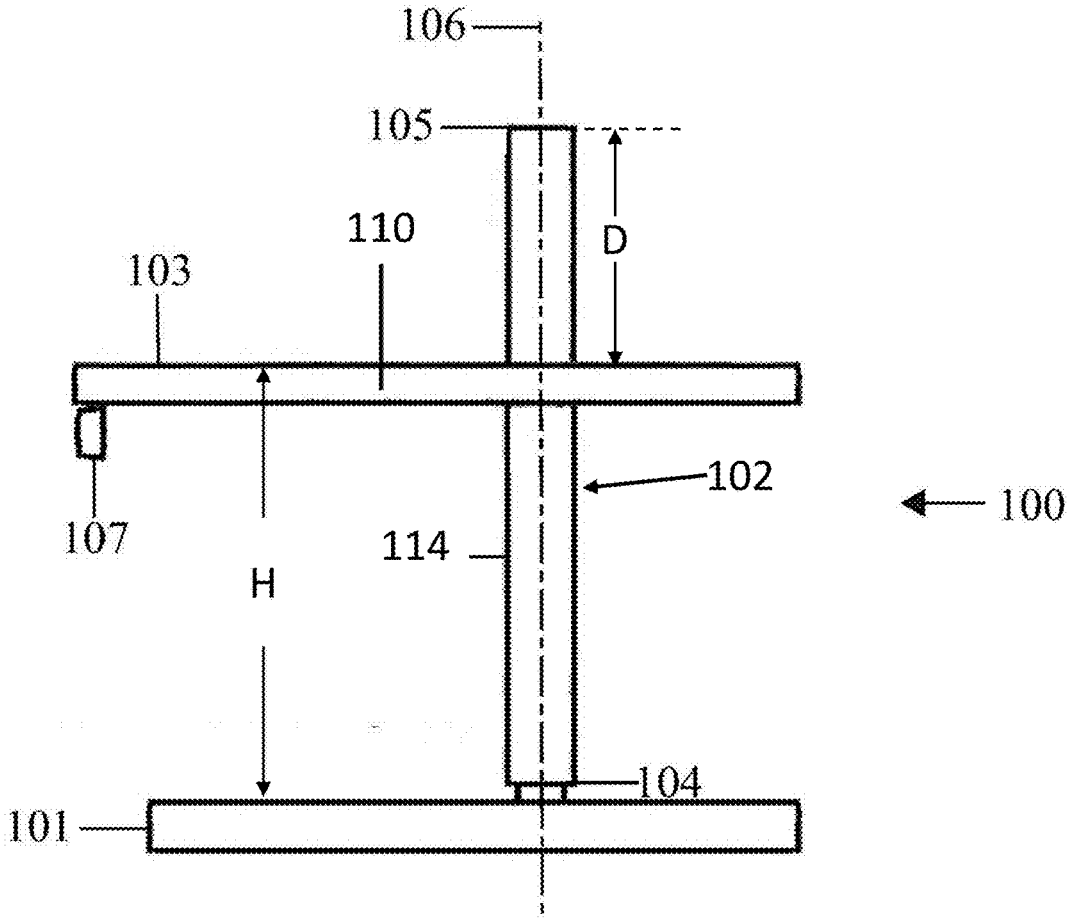
FIG. 2 is a side elevation view of the height adjustable workstation of FIG. 1, according to an example embodiment.
Figure 3:
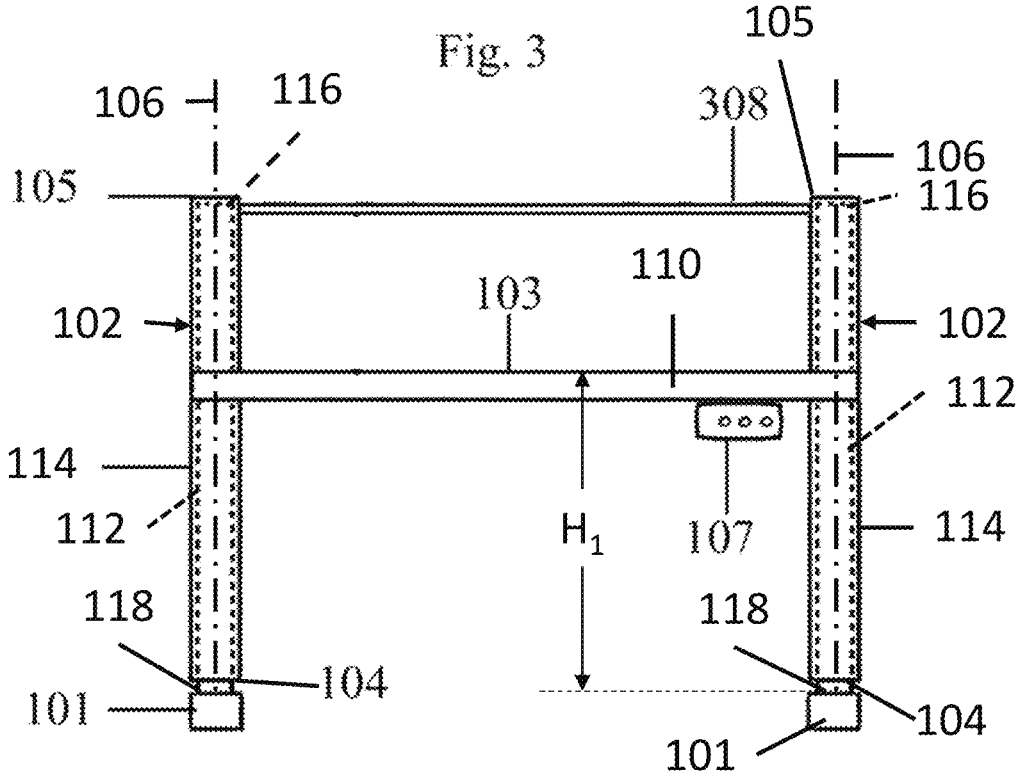
FIG. 3 is a front elevation view of a height adjustable workstation, according to another example embodiment.
Figure 4:
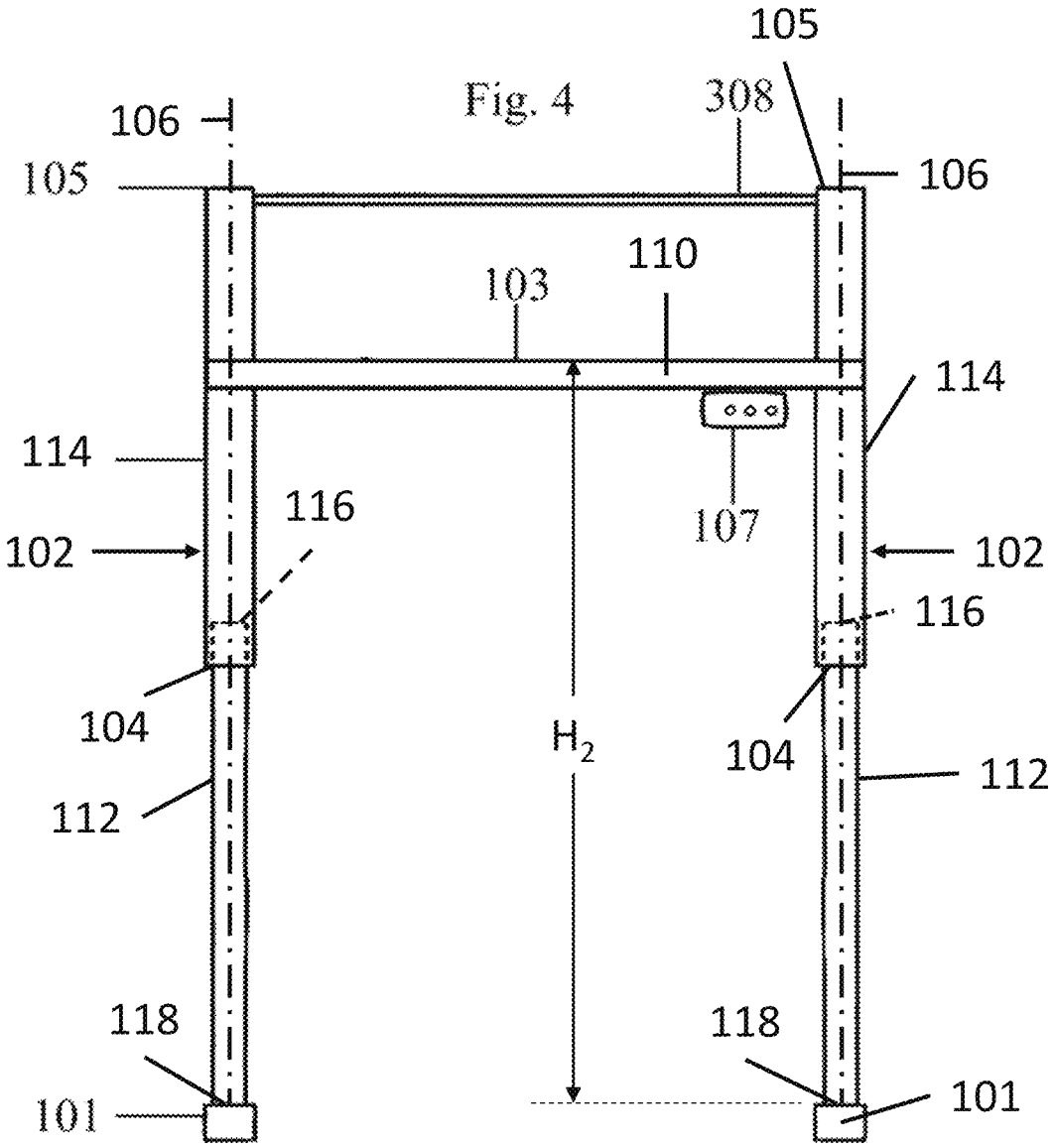
FIG. 4 is a front elevation view of the height adjustable workstation of FIG. 3 in an alternative height configuration, according to an example embodiment.

One or more advantages described herein are not meant to suggest that any one of the embodiments described herein necessarily provides all of the described advantages or that all the embodiments of the present disclosure necessarily provide any one of the described advantages. Numerous other changes, substitutions, variations, alterations, and/or modifications may be ascertained to one skilled in the art and it is intended that the present disclosure encompass all such changes, substitutions, variations, alterations, and/or modifications as falling within the scope of the appended claims FIGS. 1 and 2 show an example device 100. The device 100 may be a height adjustable workstation, which may include, for example, tables, countertops, or desks. The device 100 comprises at least one base 101. The base 101 may be the lowest part of the device 100. The base 101 may be a structure which supports other components of the device 100. The base 101 may be a structure that rests on a floor. The base 101 has a length, width, and thickness. The base 101 may be triangular, rectangular, round, oblong, flat, angled, etc. A panel 110 defining a work surface 103 is adjustably coupled to the base 101. The work surface 103 has a height H measured from the base 101 of the device 100. As shown in FIGS. 3 and 4, the panel 110 is adjustably coupled to the base 101 such that the work surface 103 is movable from a first height $H_1$ to a second height $H_2$. Optionally, the first height $H_1$ is a minimum height. Optionally, the second height $H_2$ is a maximum height.

Figure 5:
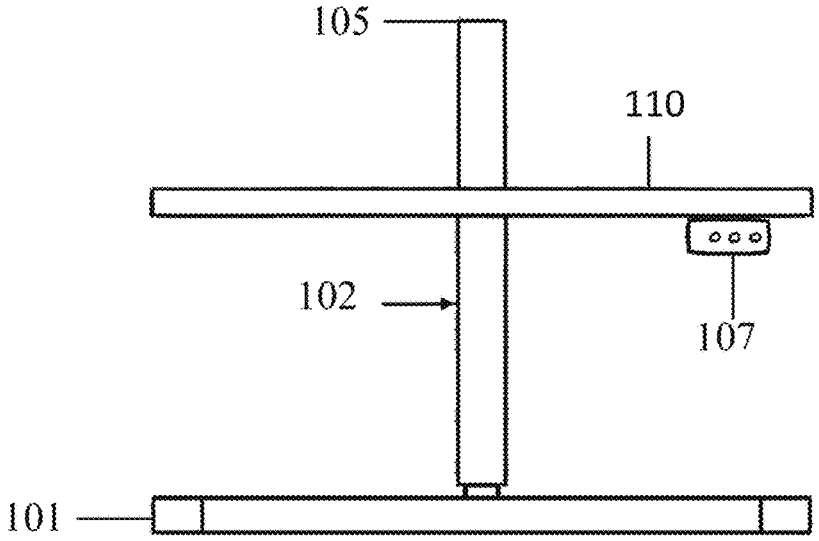
FIG. 5 is a front elevation view of a height adjustable workstation, according to another example embodiment.

As shown in FIG. 1-4, the panel 110 may be adjustably coupled to the base 101 by at least one leg 102. Although the example device 100 is shown with two legs 102, it is contemplated that the device 100 may comprise less than two legs or more than two legs, for example, the device 100 may comprise one leg 102 (shown in FIGS. 5-7) or three legs 102. Each leg 102 extends along a vertical axis 106. As shown in FIGS. 1, 3 and 4, each leg 102 may comprise a base 101 of the at least one base and a vertical support 112 coupled to the base 101. Each leg 102 may comprise a sleeve 114 having a first end 105 and a second end 104 oppositely disposed along the vertical axis 106. The second end 104 of the sleeve 114 is closer to the base 101 than the first end 105 to the base 101. The sleeve 114 may comprise an interior surface defining a receiving space configured to receive the vertical support 112. The vertical support 112 may extend into the sleeve 114 through the second end 104 of the sleeve 114 to provide stability to the sleeve 114. The cross-sectional geometry, including size and shape, of the interior surface of the sleeve 114 may correspond to the cross-sectional geometry, including size and shape, of an exterior surface of the vertical support 112 taken along a plane perpendicular or substantially perpendicular (for example, within 10° of perpendicular) to the vertical axis 106. Optionally, the shape of the cross-sectional geometry of the interior surface of the sleeve 114 and the exterior surface of the vertical support 112 may be rectangular, cylindrical, etc.

The panel 110 is attached (optionally fixed) to the sleeve 114. The panel 110 may be coupled to the sleeve 114 via one or more coupling techniques, including, for example, screws, bolts, rivets, metal inserts, snap and press fits, heat welding and sealing, etc. The sleeve 114 is movable along the vertical axis 106 relative to the vertical support 112. Moving the sleeve 114 along the vertical axis 106 moves the panel 110 which changes the height H of the work surface 103. For example, as shown in FIGS. 3 and 4, the sleeve 114 may be moved along the vertical axis 106 to adjust the height H of the work surface 103 from the first height $H_1$ to the second height $H_2$ or vice versa.

As shown in FIG. 2, the panel 110 is attached to the sleeve 114 between the first end 105 of the sleeve 114 and the second end 104 of the sleeve 114 to position the work surface 103 a distance D from the first end 105 of the sleeve 114. Further, when the work surface 103 is at a minimum height (optionally, the first height $H_1$), the panel 110 may be positioned between a first end 116 and a second end 118 of the vertical support 112 wherein the first and second ends 116, 118 are oppositely disposed along the vertical axis 106 and the second end 118 of the vertical support 112 is closer to the base 101 than the first end 116 to the base 101. Optionally, the second end 118 of the vertical support 112 is attached to the base 101. The panel 110 may be attached to the sleeve 114 between the first end 105 and the second end 104 of the sleeve 114 such that the work surface 103 is at a distance D of 2 inches to 36 inches from the first end 105 of the sleeve 114. Optionally, the panel 110 is attached to the sleeve 114 between the first end 105 and the second end 104 such that the work surface is at a distance D of 6 inches to 24 inches from the first end 105 of the sleeve 114. Attaching the panel 110 between the ends 105, 104 of the sleeve 114 may provide a wider range of first and second heights $H_1$, $H_2$ of the work surface 103. For example, the panel 110 may be positioned lower or closer to the base 101 resulting in a lower first height $H_1$, and because the first end 105 of the sleeve 114 extends beyond the work surface 103, the second height $H_2$ may be more than twice the height of the first height $H_1$. Attaching the panel 110 between the ends 105, 104 of the sleeve 114 may also allow more overlap of the sleeve 114 and vertical support 112 thereby providing more stability at ergonomic heights than there would otherwise be if the panel 110 was attached to the first end 105 of the sleeve 114. The device 100 may also improve workstation ergonomics by providing lower minimum heights of the work surface 103 and higher maximum heights of the work surface 103 than there would otherwise be if the panel 110 was attached to the first end 105 of the sleeve 114 thereby allowing users to adjust the height H of the work surface 103 to obtain ergonomic conditions while sitting or standing.

Figure 8:
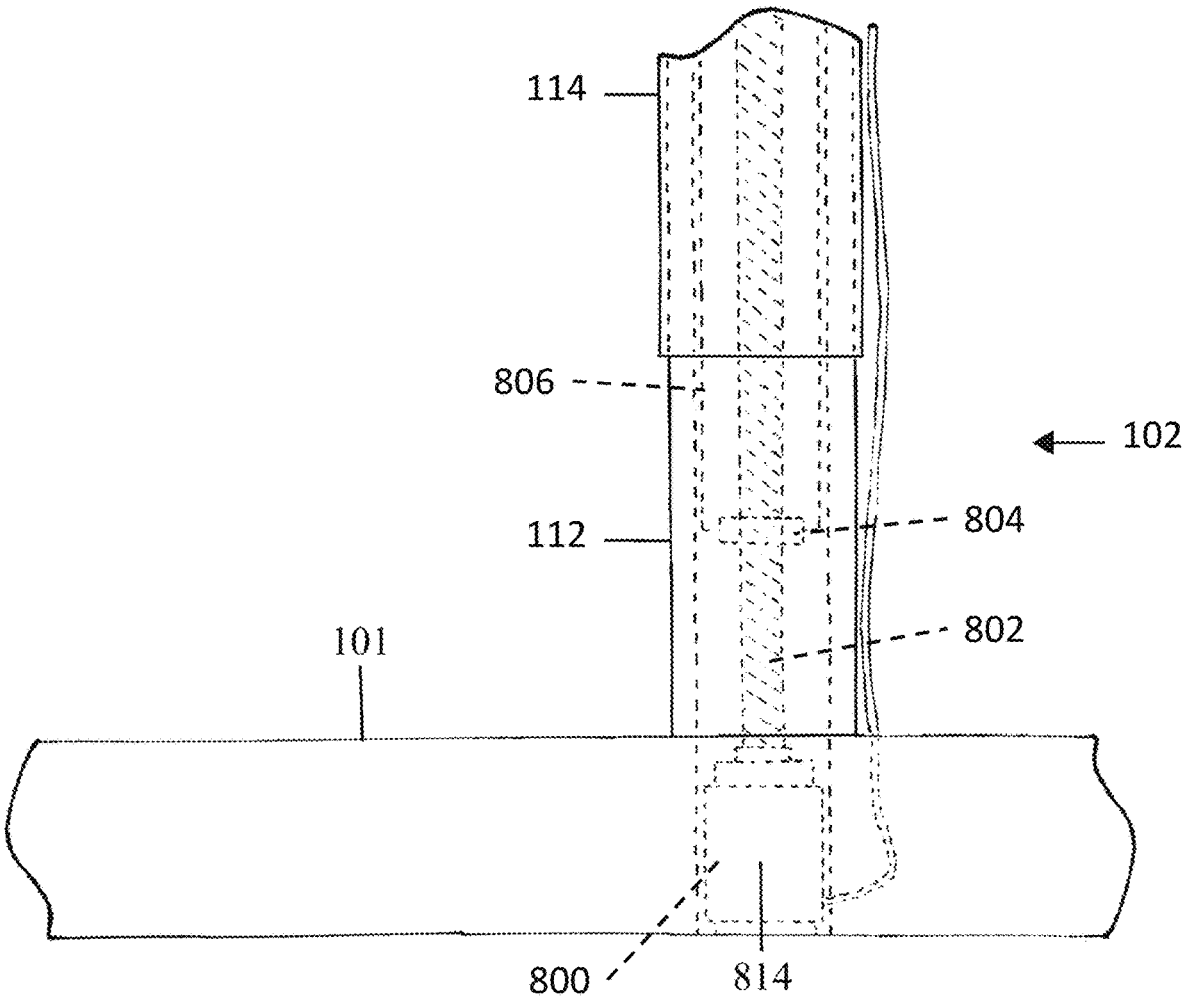
FIG. 8 is a sectional view of an actuator and height adjustment member of the height adjustable workstation of FIG. 1, according to an example embodiment.
Figure 11:
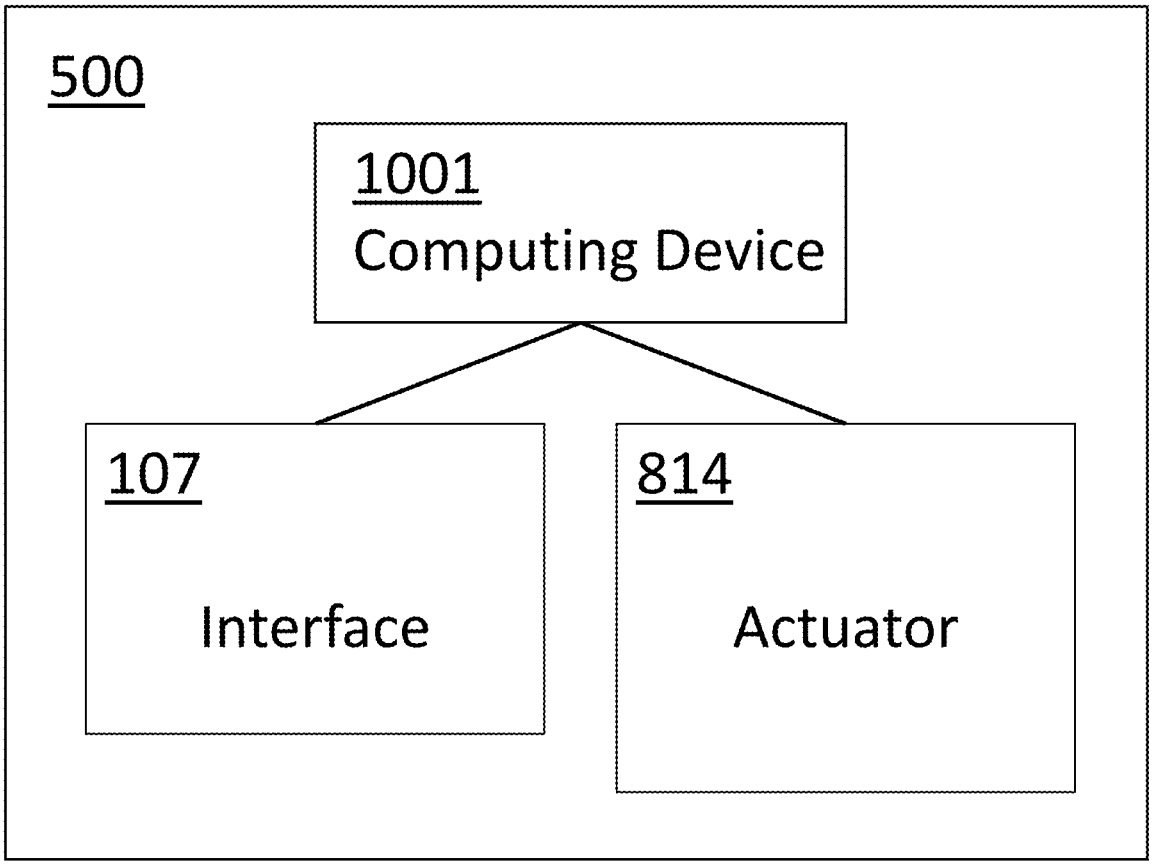
FIG. 11 shows an example control system that may be used with an example device according to the disclosure.

As shown in FIG. 8, the device 100 may comprise at least one actuator 814 configured to move each sleeve 114. Optionally, each leg 102 may include an actuator 814 configured to move the sleeve 114 of the leg 102. Optionally, the actuator 814 may comprise an electric motor, jackscrew, forklift, pulley mechanism, hydraulic cylinders, track actuators, etc. Optionally, the actuator 814 is a linear actuator (electric, hydraulic, or pneumatic). For example, the actuator 814 may comprise a motor 800 configured to rotate a screw 802. Rotation of the screw 802 may cause a nut 804 to move along the screws length. The screws length may extend parallel or substantially parallel (for example, within 10° of parallel) to the vertical axis 106 of the leg 102. Optionally, the screw 802 is arranged coaxially with the leg 102. A structure 806 coupled to the nut 804 may move along the screws length with the nut 804. The structure 806 may be coupled to the sleeve 114 such that movement of the structure 806 causes movement of the sleeve 114. The actuator 814 may be powered, whether electrically or otherwise, or may be unpowered, requiring external physical activation. As shown in FIG. 11, the actuator 814 may be activated and controlled via a control system 500. The control system 500 may comprise an interface 107. For example, the interface 107 may be but is not limited to a touchscreen, physical button, capacitive button, motion detector, proximity detector, sound detector, etc. The interface 107 may be communicatively coupled to a computing device 1001. The computing device 1001 may be communicatively coupled to the actuator 814 and configured to control the actuator 814 to move the sleeve 114 of the leg 102 to adjust the height of the work surface 103. The computing device 1001 may receive a signal from the interface 107 and control the actuator 814 based on the signal. For example, activating a button may send a signal to the computing device 1001 to cause the actuator 814 to raise the height H of the work surface 103 to move the work surface 103 from the first height $H_1$ to the second height $H_2$.

Figure 6:
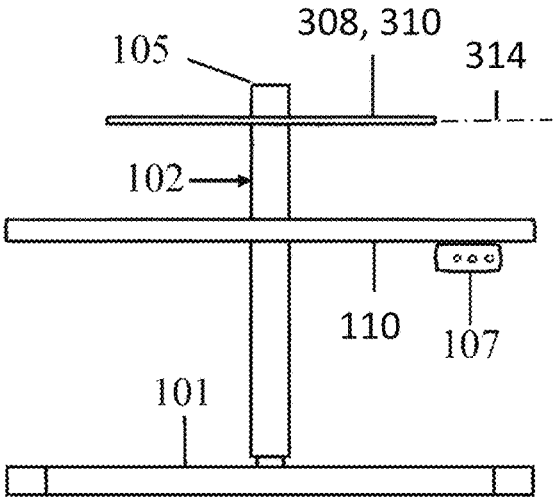
FIG. 6 is a front elevation view of a height adjustable workstation, according to another example embodiment.
Figure 7:
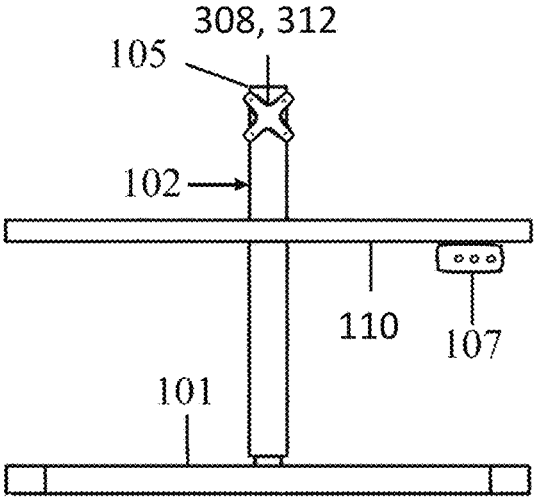
FIG. 7 is a front elevation view of a height adjustable workstation, according to another example embodiment.
Figure 9:
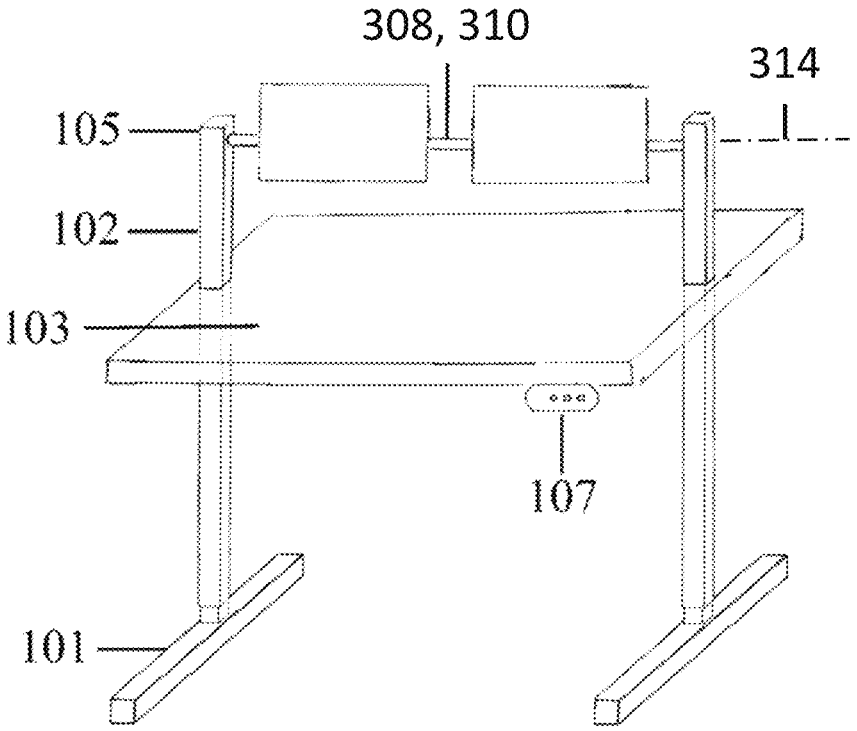
FIG. 9 is a perspective view of the height adjustable workstation of FIG. 3 with peripheral devices mounted to the workstation, according to an example embodiment.
Figure 10:
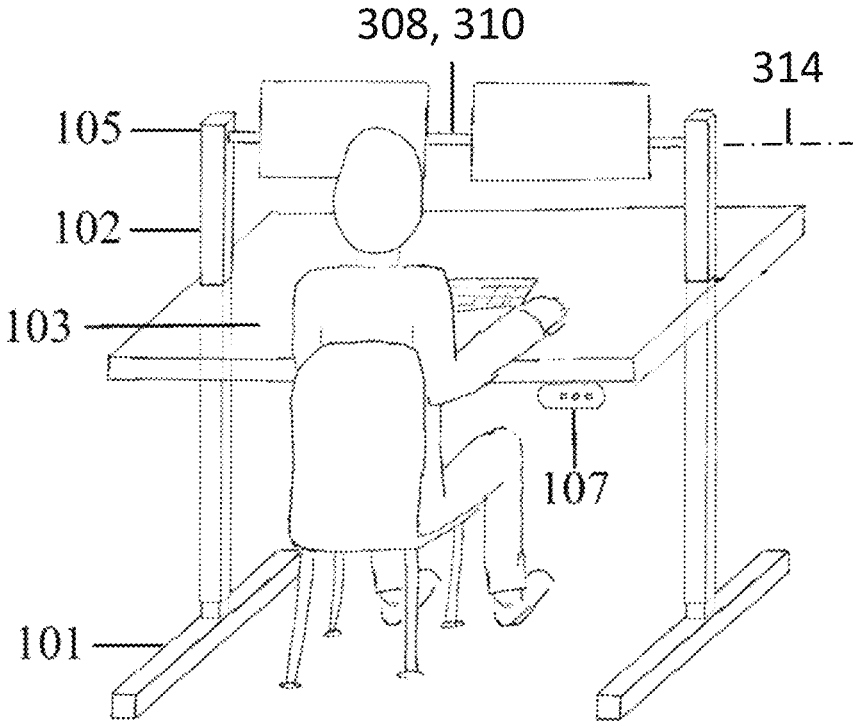
FIG. 10 is a perspective view of a person working at the height adjustable workstation of FIG. 3, according to an example embodiment.

As shown in FIGS. 3, 4, 6, 7, 9 and 10, the device 100 may comprise a mounting member 308 configured to mount peripherals such as monitors, lights, microphones, cameras, etc. For example, as shown in FIGS. 9 and 10, monitors may be mounted on the mounting member 308. The mounting member 308 may be coupled to at least one sleeve 114 between the work surface 103 and the first end 105 of the sleeve 114. The mounting member 308 may be coupled to the sleeve 114 via screws, bolts, rivets, metal inserts, snap and press fits, heat welding and/or sealing, etc. Because the mounting member 308 is coupled to the sleeve 114, the mounting member 308 moves with the sleeve 114 along the vertical axis 106. As shown in FIGS. 6, 9, and 10, the mounting member 308 may comprise a bar 310. Optionally, the mounting member 308 (for example, the bar 310) may extend along a mounting member axis 314 perpendicular or substantially perpendicular (for example, within 10° of perpendicular) to the vertical axis 106. As shown in FIG. 7, the mounting member 308 may comprise a bracket 312. Attaching at least some peripherals to the mounting member 308 may allow the work surface 103 to be used for other peripherals or may allow the work surface 103 to be less cluttered. Further, it allows peripherals to be positioned at ergonomic heights by allowing them to be positioned above the work surface 103.

An example method of using the device disclosed herein may include moving the work surface from a third height to a fourth height. The third height and the fourth height may be equal to or between the first height and the second height.

The method of using the device disclosed herein may further comprise attaching the panel to the sleeve between the first end and the second end. The method may include attaching the panel to the sleeve between 2 inches and 36 inches from the first end. Alternatively, the method may include attaching the panel to the sleeve between 6 inches and 24 inches from the first end.

It is expected that the example devices and methods according to the disclosure will improve workstation ergonomics by providing a wider ranger of work surface heights, more work surface area, and/or the ability to adjust placement of monitors or other peripheral devices. The example devices including adjustable workstations and methods of adjusting the height of the device (e.g. workstation) may further increase efficiency and productivity while reducing risk of injury and discomfort to the user.

All of the embodiments of the claimed disclosure described herein are provided expressly by way of example only. Innumerable variations and modifications may be made to the example embodiments described herein without departing from the concept of this disclosure. Additionally, the scope of this disclosure is intended to encompass any and all modifications and combinations of all elements, features, and aspects described in the specification and claims, and shown in the drawings. Any and all such modifications and combinations are intended to be within the scope of this disclosure.

Control System

Figure 12:
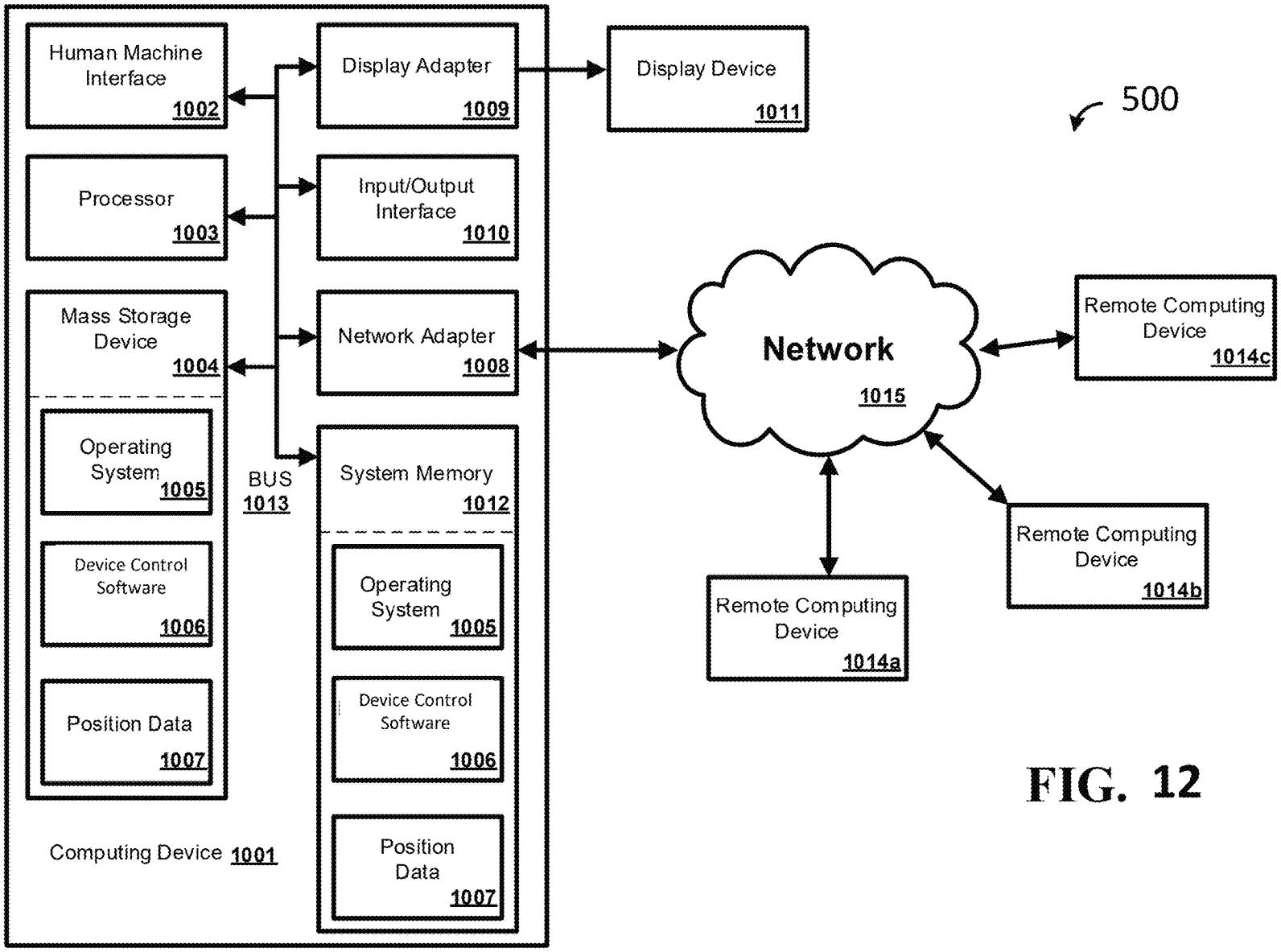
FIG. 12 is a block diagram of an example control system comprising a computing device as disclosed herein for controlling the device according to the disclosure.

FIG. 12 shows an example control system 500 including an exemplary configuration of a computing device 1001 for use with the device 100 disclosed herein. The control system 500 may control the device 100. The control system 500 may be used to operate the device 100 as described herein. Specifically, the control system 500 may be used to move the work surface 103 from the third height to the fourth height. The computing device 1001 may comprise one or more processors 1003, a system memory 1012, and a bus 1013 that couples various components of the computing device 1001 including the one or more processors 1003 to the system memory 1012. In the case of multiple processors 1003, the computing device 1001 may utilize parallel computing. The bus 1013 may comprise one or more of several possible types of bus structures, such as a memory bus, memory controller, a peripheral bus, an accelerated graphics port, and a processor or local bus using any of a variety of bus architectures.

The computing device 1001 may operate on and/or comprise a variety of computer readable media (e.g., non-transitory). Computer readable media may be any available media that is accessible by the computing device 1001 and comprises, non-transitory, volatile and/or non-volatile media, removable and non-removable media. The system memory 1012 has computer readable media in the form of volatile memory, such as random access memory (RAM), and/or non-volatile memory, such as read only memory (ROM). The system memory 1012 may store data such as position data 1007 of the work surface 103 or sleeve 114 and/or program modules such as operating system 1005, and device control software 1006 for controlling the device 100, specifically, the actuator.

The computing device 1001 may also comprise other removable/non-removable, volatile/non-volatile computer storage media. The mass storage device 1004 may provide non-volatile storage of computer code, computer readable instructions, data structures, program modules, and other data for the computing device 1001. The mass storage device 1004 may be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like. Any number of program modules may be stored on the mass storage device 1004. An operating system 1005 and software 1006 may be stored on the mass storage device 1004.

A user may enter commands and information into the computing device 1001 using the interface/input device. Such input devices comprise, but are not limited to, a joystick, a touchscreen display, a keyboard, a pointing device (e.g., a computer mouse, remote control), a microphone, a scanner, tactile input devices such as gloves, and other body coverings, motion sensor, speech recognition, and the like. These and other input devices may be connected to the one or more processors 1003 using a human machine interface 1002 that is coupled to the bus 1013, but may be connected by other interface and bus structures, such as a parallel port, game port, an IEEE 1394 Port (also known as a Firewire port), a serial port, network adapter 1008, and/or a universal serial bus (USB).

A display device 1011 may also be connected to the bus 1013 using an interface, such as a display adapter 1009. It is contemplated that the computing device 1001 may have more than one display adapter 1009 and the computing device 1001 may have more than one display device 1011. A display device 1011 may be a monitor, an LCD (Liquid Crystal Display), light emitting diode (LED) display, television, smart lens, smart glass, and/or a projector. The display 1011 and computing device 1001 may be part of one device, or separate devices.

The computing device 1001 may operate in a networked environment using logical connections to one or more remote computing devices 1014*a,b,c*. A remote computing device 1014*a,b,c* may be a personal computer, computing station (e.g., workstation), portable computer (e.g., laptop, mobile phone, tablet device), smart device (e.g., smartphone, smart watch, activity tracker, smart apparel, smart accessory), security and/or monitoring device, a server, a router, a network computer, a peer device, edge device or other common network node, and so on. The remote computing devices 1014*a,b,c*, can perform respective operations of the device. Logical connections between the computing device 1001 and a remote computing device 1014*a,b,c* may be made using a network 1015, such as a local area network (LAN) and/or a general wide area network (WAN), or a Cloud-based network. Such network connections may be through a network adapter 1008. A network adapter 1008 may be implemented in both wired and wireless environments. Such networking environments are conventional and commonplace in dwellings, offices, enterprise-wide computer networks, intranets, and the Internet. It is contemplated that the remote computing devices 1014*a,b,c* can optionally have some or all of the components disclosed as being part of computing device 1001. In various further aspects, it is contemplated that some or all aspects of data processing described herein can be performed via cloud computing on one or more servers or other remote computing devices. Accordingly, at least a portion of the system 500 can be configured with internet connectivity.

The control system 500 may be used to operate the device 100 as described herein. The control system 500 may be used to control the actuator 814 to move the sleeve 114 along the vertical axis 106 to adjust the height H of the work surface 103.

Exemplary Aspects

In view of the described devices and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A device comprising:

a base; and a panel defining a work surface having a height measured from the base, wherein the panel is adjustably coupled to the base such that the work surface is moveable from a first height to a second height, wherein the second height is more than twice the first height.

Aspect 2: The device according to aspect 1 further comprising at least one leg, each leg of the at least one leg extending along a vertical axis and comprising:

the base, a vertical support coupled to the base, and a sleeve having a first end and a second end oppositely disposed along the vertical axis, wherein the second end is closer to the base than the first end to the base, wherein the sleeve is movable along the vertical axis relative to the vertical support, wherein the panel is attached to the sleeve between the first end and the second end, and wherein the height is measured along an axis parallel or substantially parallel to the vertical axis.

Aspect 3: The device according to aspect 2, wherein the panel is attached to the sleeve between the first end and the second end such that the work surface is between 2 inches and 36 inches from the first end.

Aspect 4: The device according to aspect 3, wherein the panel is attached to the sleeve between the first end and the second end such that the work surface is between 6 inches and 24 inches from the first end.

Aspect 5: The device according to any of aspects 2-4 further comprising a mounting member attached to the sleeve between the first end and the work surface, wherein the mounting member is configured to support at least one monitor.

Aspect 6: The device according to aspect 5, wherein the mounting member extends along a mounting member axis perpendicular or substantially perpendicular to the vertical axis.

Aspect 7: The device according to any of aspects 2-6, wherein each leg of the at least one leg further comprises an actuator configured to move the sleeve along the vertical axis.

Aspect 8: The device according to any of aspects 2-7, wherein the vertical support extends into the sleeve through the second end.

Aspect 9: A device comprising:

at least one leg, each leg of the at least one leg extending along a vertical axis and comprising:

a base, a vertical support coupled to the base, and a sleeve having a first end and a second end oppositely disposed along the vertical axis, wherein the second end is closer to the base than the first end to the base, wherein the sleeve is movable along the vertical axis relative to the vertical support; and a panel defining a work surface having a height measured from the base along an axis parallel or substantially parallel to the vertical axis, wherein the panel is attached to the sleeve between the first end and the second end, wherein the sleeve is configured to adjust the height of the work surface.

Aspect 10: The device according to aspect 9, wherein the panel is attached to the sleeve between the first end and the second end such that the work surface is between 2 inches and 36 inches from the first end.

Aspect 11: The device according to aspect 10, wherein the panel is attached to the sleeve between the first end and the second end such that the work surface is between 6 inches and 24 inches from the first end.

Aspect 12: The device according to any of aspects 9-11 further comprising a mounting member attached to the sleeve between the first end and the work surface, wherein the mounting member is configured to support at least one monitor.

Aspect 13: The device according to aspect 12, wherein the mounting member extends along a mounting member axis perpendicular or substantially perpendicular to the vertical axis.

Aspect 14: The device according to any of aspects 9-13, wherein each leg of the at least one leg further comprises an actuator configured to move the sleeve along the vertical axis.

Aspect 15: The device according to any of aspects 9-14, wherein the vertical support extends into the sleeve through the second end.

Aspect 16: The device according to any of aspects 9-15, wherein the sleeve is configured to move the work surface from a first height to a second height, wherein the second height is more than twice the first height.

Aspect 17: A method of adjusting a device, the device comprising:

a panel defining a work surface, the work surface having a height measured from a base of the device, wherein the work surface is moveable from a first height to a second height, wherein the second height is more than twice the first height, the method comprising:

moving the work surface from a third height to a fourth height, wherein the third height and the fourth height are between the first height and the second height.

Aspect 18: The method according to aspect 17, wherein the device further comprises:

at least one leg, each leg of the at least one leg extending along a vertical axis and comprising:

the base of the device, a vertical support coupled to the base, and a sleeve having a first end and a second end oppositely disposed along the vertical axis, wherein the second end is closer to the base than the first end to the base, wherein the sleeve is movable along the vertical axis relative to the vertical support, the method further comprising:

attaching the panel to the sleeve between the first end and the second end.

Aspect 19: The method according to aspect 17, wherein the device further comprises:

at least one leg, each leg of the at least one leg extending along a vertical axis and comprising:

the base of the device, a vertical support coupled to the base, and a sleeve having a first end and a second end oppositely disposed along the vertical axis, wherein the second end is closer to the base than the first end to the base, wherein the sleeve is movable along the vertical axis relative to the vertical support, the method further comprising:

attaching the panel to the sleeve between 2 inches and 36 inches from the first end.'

Aspect 20: The method according to aspect 17, wherein the device further comprises:

at least one leg, each leg of the at least one leg extending along a vertical axis and comprising:

the base of the device, a vertical support coupled to the base, and a sleeve having a first end and a second end oppositely disposed along the vertical axis, wherein the second end is closer to the base than the first end to the base, wherein the sleeve is movable along the vertical axis relative to the vertical support, the method further comprising:

attaching the panel to the sleeve between 6 inches and 24 inches from the first end.

What is claimed is:

1. A device comprising:

at least one base;

a panel defining a work surface having a height measured from the base, the panel comprising a front edge and rear edge spaced along a horizontal axis, wherein the panel is adjustably coupled to the base such that the work surface is moveable from a first height to a second height, wherein the second height is more than twice the first height:

at least one leg, each leg of the at least one leg extending along a vertical axis and comprising:

a vertical support coupled to the at least one base, and a sleeve having a first end and a second end oppositely disposed along the vertical axis, wherein the second end is closer to the base than the first end is to the base, wherein the panel is attached to the sleeve between the first end and the second end at about a midpoint between the forward edge and the rear edge of the panel, wherein the sleeve is movable along the vertical axis relative to the vertical support; and a mounting member attached to the sleeve between the first end and the work surface, wherein the mounting member is configured to support at least one monitor.

2. The device according to claim 1, wherein the height is measured along an axis parallel or substantially parallel to the vertical axis.

3. The device according to claim 1, wherein the panel is attached to the sleeve between the first end and the second end such that the work surface is between 2 inches and 36 inches from the first end.

4. The device according to claim 3, wherein the panel is attached to the sleeve between the first end and the second end such that the work surface is between 6 inches and 24 inches from the first end.

5. The device according to claim 1, wherein the mounting member extends along a mounting member axis perpendicular or substantially perpendicular to the vertical axis.

6. The device according to claim 1, wherein each leg of the at least one leg further comprises an actuator configured to move the sleeve along the vertical axis.

7. The device according to claim 1, wherein the vertical support extends into the sleeve through the second end.

8. A device comprising:

at least one leg, each leg of the at least one leg extending along a vertical axis and comprising:

a base, a vertical support coupled to the base, and a sleeve having a first end and a second end oppositely disposed along the vertical axis, wherein the second end is closer to the base than the first end to the base, wherein the sleeve is movable along the vertical axis relative to the vertical support; and a panel defining a work surface having a height measured from the base along an axis parallel or substantially parallel to the vertical axis, the panel comprising a front edge and a rear edge spaced along a horizontal axis, wherein the panel is attached to the sleeve between the first end and the second end at about a midpoint between the forward edge and the rear edge of the panel, wherein the sleeve is configured to adjust the height of the work surface; and a mounting member attached to the sleeve between the first end and the work surface, wherein the mounting member is configured to support at least one monitor.

9. The device according to claim 8, wherein the panel is attached to the sleeve between the first end and the second end such that the work surface is between 2 inches and 36 inches from the first end.

10. The device according to claim 9, wherein the panel is attached to the sleeve between the first end and the second end such that the work surface is between 6 inches and 24 inches from the first end.

11. The device according to claim 8, wherein the mounting member extends along a mounting member axis perpendicular or substantially perpendicular to the vertical axis.

12. The device according to claim 8, wherein each leg of the at least one leg further comprises an actuator configured to move the sleeve along the vertical axis.

13. The device according to claim 8, wherein the vertical support extends into the sleeve through the second end.

14. The device according to claim 8, wherein the sleeve is configured to move the work surface from a first height to a second height, wherein the second height is more than twice the first height.

15. A method of adjusting the device according to claim 8, the method comprising:

moving the work surface from a first height to a second height.

16. The method according to claim 15, wherein the the method further comprises:

attaching the panel to the sleeve between the first end and the second end.

17. The method according to claim 15, wherein the method further comprises:

attaching the panel to the sleeve between 2 inches and 36 inches from the first end.

18. The method according to claim 15, wherein the method further comprising:

attaching the panel to the sleeve between 6 inches and 24 inches from the first end.

* * * * *